United States Patent [19]

Martin

[11] 4,416,756

[45] Nov. 22, 1983

[54] ELECTROTREATING APPARATUS WITH DEPLETABLE ANODE ROLL

[75] Inventor: Frank A. Martin, Merrillville, Ind.

[73] Assignee: Inland Steel Company, Chicago, Ill.

[21] Appl. No.: 454,616

[22] Filed: Dec. 30, 1982

[51] Int. Cl.[3] ..... C25D 17/00

[52] U.S. Cl. ..... 204/206; 204/224 R

[58] Field of Search ..... 204/206, 224 R, 207

[56] References Cited

U.S. PATENT DOCUMENTS

| | | | |
|---|---|---|---|
| 3,008,892 | 11/1961 | Owen | 204/207 |
| 3,374,159 | 3/1968 | Poole | 204/224 R |
| 3,541,083 | 11/1970 | Beemer | 204/224 R |
| 3,619,343 | 11/1971 | Eisner . | |
| 3,619,383 | 11/1971 | Eisner . | |
| 4,082,632 | 4/1978 | Whittle | 204/224 R |

*Primary Examiner*—T. M. Tufariello

*Attorney, Agent, or Firm*—Merriam, Marshall & Bicknell

[57] ABSTRACT

An electrocoating apparatus located totally above a bath of electrolytic liquid and comprising a depletable anode roll having an outer layer of coating metal. Another roll is axially parallel to and vertically spaced from the anode roll. A closed loop of electrically insulative, porous mesh material extends around a portion of the peripheral surface of each roll to form the closed loop. A strip of metal is wrapped around a portion of the anode roll, with the porous mesh interposed between the strip's inner surface and the anode roll's peripheral surface. There is an upstream nip between the strip and the anode roll. The two rolls and the mesh loop are rotated, and the metal strip is advanced in a downstream direction, all at the same speed. Electrolytic liquid is introduced at the upstream nip and is retained between the anode roll and that part of the strip which is wrapped around the anode roll. Metal is coated on the inner surface of the strip, and the anode roll undergoes depletion.

14 Claims, 7 Drawing Figures

FIG. 1
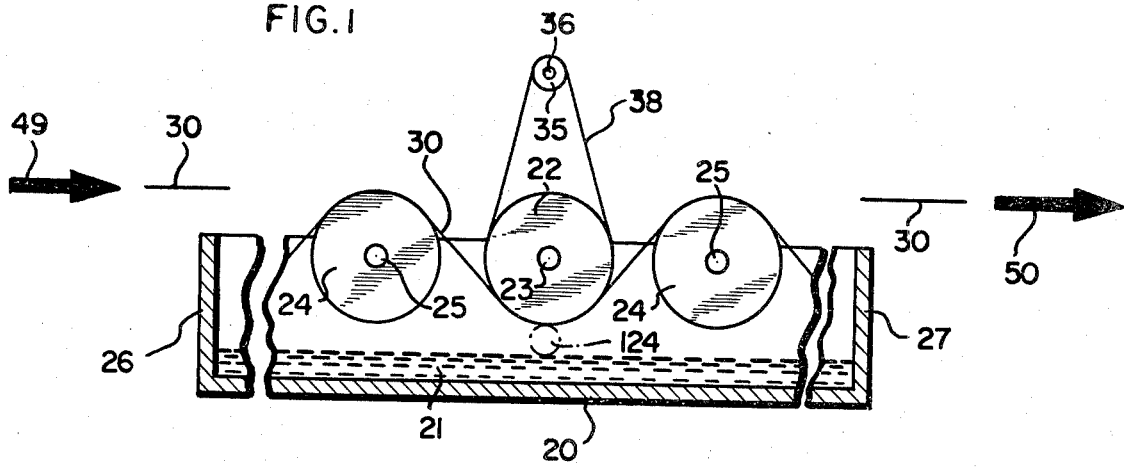
FIG. 2
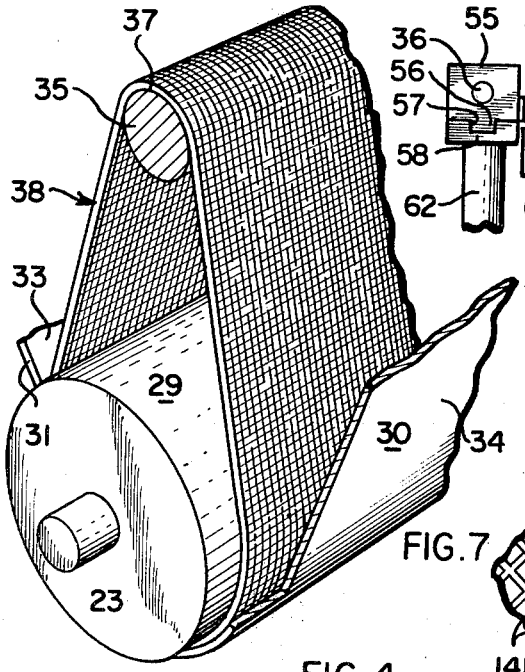
FIG. 3A
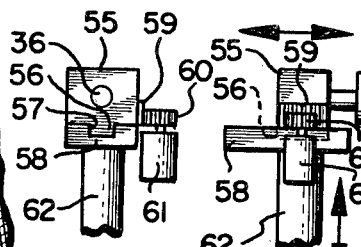
FIG. 3
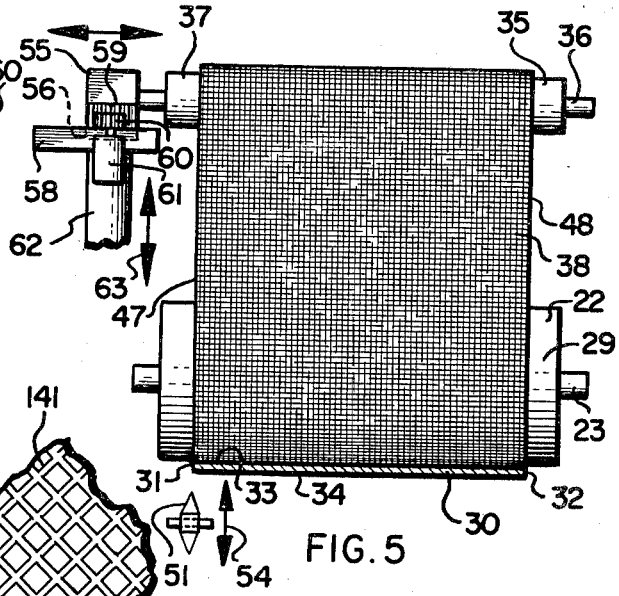
FIG. 7
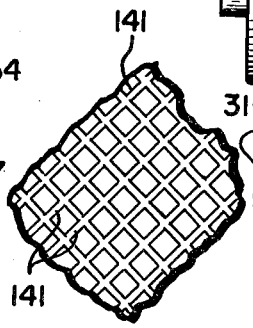
FIG. 4
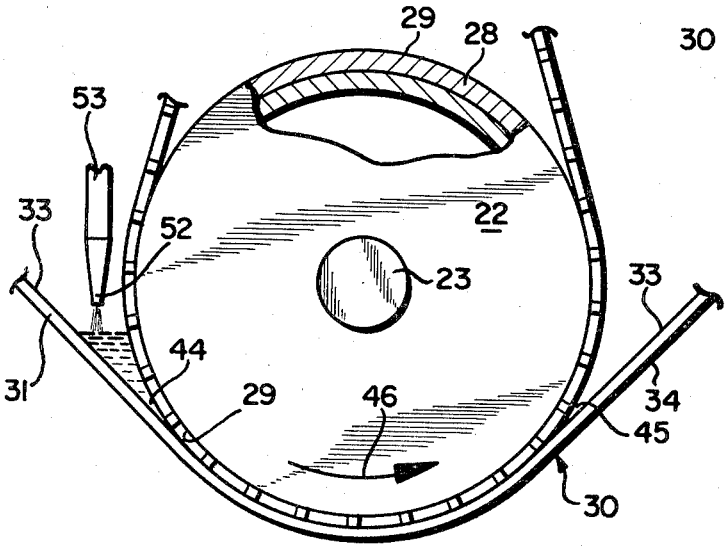
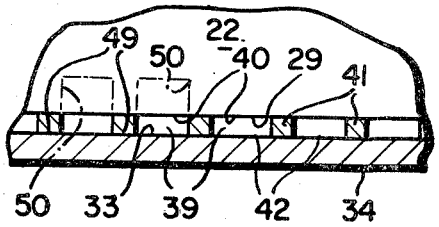
FIG. 6
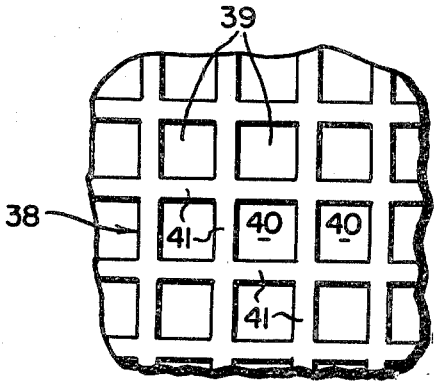

ELECTROTREATING APPARATUS WITH DEPLETABLE ANODE ROLL

BACKGROUND OF THE INVENTION

The present invention relates generally to apparatus for electrotreating a metal strip and more particularly to electrotreating apparatus with a depletable anode roll.

An example of electrotreating is the electrolytic plating of a surface of a metal strip, e.g., electrolytic galvanizing wherein a steel strip is plated with zinc. Other examples of electrotreating include the electrolytic cleaning or pickling of a surface of the metal strip. In all these examples the metal strip is electrically charged and constitutes one electrode in an electrolytic cell having another electrode with electrolytic liquid between the two electrodes. An electric current flows through the electrolytic liquid between the metal strip and the other electrode, and, depending upon whether the metal strip is to be plated or cleaned, ions flow to or from a strip surface to be either deposited thereon or removed therefrom.

For example, in an electrogalvanizing operation, the metal strip is provided with a negative charge, so as to be a cathode, a metallic anode is placed adjacent the metal strip surface to be coated, and the electrolytic liquid contains zinc ions. The anode may be depletable, in which case it is composed of zinc.

It is often desirable to coat only one surface of the metal strip with zinc, and in such a case, a zinc anode is placed alongside only that surface of the metal strip which is to be coated.

A recently developed electroplating process employs a horizontally disposed, cylindrical, depletable anode roll comprising an outer layer composed of the plating metal (e.g., zinc) and having a peripheral surface. The depletable anode roll is located totally above a bath of electrolytic liquid, and the roll itself is not in contact with the bath. A continuous metal strip having opposed flat surfaces is wrapped around a substantial portion of the anode roll, with an inner surface of the strip in closely spaced relation to the conductive, peripheral surface of the anode roll. The metal strip is advanced in a downstream direction, and the roll is simultaneously rotated while maintaining the wrapped-around, spaced relationship between the strip and the roll.

As the strip advances in a downstream direction, the inner surface of the wrapped-around portion of the strip is electroplated, from one side edge of the strip to the other side edge thereof, without electroplating the other surface of the strip. This is accomplished by maintaining an electrolytic liquid in the space between the anode roll's peripheral surface and the inner surface of the wrapped-around portion of the strip, from one side edge of the strip to the other side edge thereof, while, at the same time, maintaining the outer surface of the strip out of contact with the electrolytic liquid.

The arrangement described in the preceding sentence is accomplished by surrounding the peripheral surface of the anode roll with a concentric layer of mesh composed of electrically insulative material which prevents direct electrical contact between the strip and the anode roll's peripheral surface. The anode roll's peripheral surface and the mesh together define a multiplicity of open-end electrotreating sites each having an inner base defined by a part of the roll's peripheral surface, site-enclosing side walls defined by a part of the mesh, and an open outer end opposite the base. Wrapping the continuous metal strip around a portion of the roll's peripheral surface closes the sites on the wrapped portion of the anode roll. As the strip advances in a downstream direction and the anode roll rotates, those sites which were previously covered become uncovered, and sites on a portion of the roll previously not wrapped by the strip become covered.

An electrolytic liquid is introduced onto the peripheral surface of the anode roll at a location at or in advance of the location where the metal strip joins the roll, and this floods with liquid the sites closed by the strip as the strip advances and the roll rotates. This creates an electrolytic cell at each closed site wherein that portion of the roll's peripheral surface defining the site's inner base is the anode, that portion of the strip's inner surface closing that site is the cathode and the electrolytic liquid confined within the closed site is the electrolytic bath.

Because the inner surface of the strip is in contact with the electrolytic liquid, while the outer surface of the strip is not, the deposition of cation on the outer surface of the strip is effectively prevented.

The electroplating process and apparatus described above is disclosed in more detail in the prior filed, commonly-owned U.S. application Ser. No. 424,858 filed Sept. 27, 1982, entitled "Method and Apparatus for Electro-Treating a Metal Strip," William A. Carter inventor; and the disclosure thereof is incorporated herein by reference.

A problem arises when a continuous metal strip is electroplated with a depletable anode roll covered by a concentric layer of mesh composed of electrically insulative material. The concentric mesh layer overlies the entirety of the anode roll's peripheral surface and is essentially stationary thereon. The mesh is typically composed of criss-crossing strands of electrically insulative material defining either a regular grid pattern or an irregular pattern. During an electroplating operation, the depletable anode roll erodes at those areas of its peripheral surface not covered by the strands of electrically insulative mesh material, but the anode roll's peripheral surface does not erode where the mesh strands contact the roll.

Because there is selective erosion of those areas of the roll's peripheral surface not covered by the mesh strands, while those areas of the peripheral surface covered by the mesh strands do not erode, cratering occurs on the roll's peripheral surface. The craters become deeper and deeper and the ridges between craters become relatively higher and higher as the electroplating operation proceeds. This is wasteful with regard to the plating metal because those parts of the depletable anode rolls forming the crater rims are not utilized in the plating operation. In addition, cratering causes premature destruction of the mesh layer, requiring frequent replacement thereof.

The aforementioned problems are indigenous to a depletable anode roll and can be avoided by utilizing a non-depletable anode roll composed of some metal other than that which is to be plated on the metal strip. For example, in an electrogalvanizing operation, the anode roll may comprise lead as the outer layer. In such a case, the cation of zinc to be plated out on the metal strip through the medium of the electrolytic liquid must be continuously supplied to the liquid from some source other than the anode roll. Such an arrangement is not as convenient as supplying the zinc cation from a depletable zinc anode roll. In addition, there are other advantages to employing a depletable zinc anode roll versus a non-depletable lead anode roll.

For one thing, a zinc anode requires less power to perform the electroplating process than does a lead anode, and a zinc anode generates less heat than does a lead anode so that the electrolytic liquid needs substantially less cooling. In addition, when the anode roll's outer layer is composed of lead, the electrolytic liquid must be a zinc sulfate solution; however, when the anode roll's outer layer is composed of zinc, the electrolytic liquid may be either a zinc sulfate solution or a zinc chloride solution. Zinc chloride solution is a better conductor than zinc sulfate solution, thereby decreasing the resistance and increasing the current density. Zinc chloride solution cannot be used when the anode roll's outer layer is composed of lead because a chloride skin will form on the lead anode and, in effect, kill the lead anode electrically. The chloride skin has a high electrical resistance.

Moreover, when the anode roll's outer layer is composed of lead, the $H_2O$ in the dilute acid solution contained in the electrolytic liquid is broken down at the lead anode into hydrogen plus oxygen, and the oxygen takes up space in the sites which contain the electrolytic liquid. This reduces the amount of electrolytic liquid which can be contained in a site, which is undesirable. This is not a problem, however, when employing a zinc anode and zinc chloride solution.

SUMMARY OF THE INVENTION

The present invention retains all the advantages derived from utilizing a layer of electrically insulative, porous mesh material around a depletable anode roll, while eliminating the cratering problem. This is accomplished by utilizing an arrangement of the type described below.

As was the case in the past, the present invention employs a depletable anode roll having an outer layer composed of plating metal. This outer layer has a peripheral surface. There is another roll, axially parallel to and spaced from the anode roll. This other roll also has a peripheral surface.

Rather than employing the electrically insulative, porous mesh as a concentric layer completely surrounding the outer surface of the anode roll, the present invention employs the mesh in the form of a closed loop extending around a portion of the peripheral surface of both the anode roll and the other roll, to form the closed loop.

Each of the two rolls is mounted for rotation, and both rotate at the same time. As the anode roll rotates, it causes the loop of porous mesh material to rotate, in turn moving each point on the porous mesh through a series of circuits along a predetermined path defined by the closed loop.

In accordance with the present invention, structure is provided for assuring that different areas on the peripheral surface of the anode roll are left uncovered by the mesh strands on different circuits of the loop. This provides for relatively uniform erosion of the outer layer of the depletable anode roll during an electrolytic plating process, and cratering is eliminated.

Other features and advantages of the apparatus claimed and disclosed will become apparent to those skilled in the art from the following detailed description in conjunction with the accompanying diagrammatic drawings.

BRIEF DESCRIPTION OF THE DRAWINGS

FIG. 1 is a diagram showing an embodiment of apparatus in accordance with the present invention;

FIG. 2 is a fragmentary perspective of the apparatus;

FIG. 3 is an end view of the apparatus;

FIG. 3A is a fragmentary side view of the apparatus of FIG. 3;

FIG. 4 is an enlarged side view, partially in section and partially cut away, of a portion of the apparatus;

FIG. 5 is an enlarged, fragmentary end view, partially in section, of a portion of the apparatus, and FIG. 6 is an enlarged, fragmentary end view of a portion of the apparatus; and FIG. 7 is a view similar to FIG. 6 showing a different mesh pattern from that shown in FIG. 6.

DETAILED DESCRIPTION

Referring initially to FIGS. 1–4, there is illustrated an embodiment of an apparatus in accordance with the present invention and comprising a tank 20 having upstream and downstream ends 26, 27, respectively, and containing a bath 21 of electrolytic liquid. Located above bath 21 is a cylindrical, depletable anode roll 22, having an outer layer 28 composed of plating metal such as zinc (FIG. 4). Outer layer 28 has a peripheral surface 29. Anode roll 22 comprises a shaft 23 which rotatably mounts roll 22 employing conventional bearing structure (not shown). Located upstream and downstream of anode roll 22 are additional cylindrical rolls 24, 24 each having a shaft 25 and each rotatably mounted employing conventional bearing structure (not shown). Rolls 22 and 24, 24 are electrically isolated from the rest of the apparatus in a conventional manner commonly employed in the electrotreating of metal strip.

Disposed axially parallel to and spaced vertically above anode roll 22 is another roll 35 having a peripheral surface 37. Roll 35 comprises a shaft 36 which rotatably mounts roll 35 employing conventional bearing structure (not shown).

Illustrated at 38 is a closed loop composed of electrically insulative, porous mesh which extends around a portion of the peripheral surface 29, 37 of each roll 22, 35 respectively to form the closed loop.

Trained alternately over the top portion of a roll 24 and under the bottom portion of anode roll 22 is a continuous metal strip 30 having a pair of side edges 31, 32, a top or inner surface 33 and a bottom or outer surface 34 (FIGS. 1–5).

Mesh loop 38 is interposed between the anode roll's peripheral surface 29 and metal strip 30 and prevents direct electrical contact between strip 30 and the anode roll's peripheral surface 29. Peripheral surface 29 and the adjacent portion of mesh loop 38 define a multiplicity of open-end electrotreating sites 39, 39 (FIGS. 5–6) each having an inner base 40 defined by a part of the anode roll's peripheral surface 29, site-enclosing side walls 41, 41 defined by intersecting strands of mesh loop 38 and an open outer end 42 opposite base 40.

Training metal strip 30 alternately around rolls 24, 22 in the manner illustrated in FIG. 1 causes a portion of continuous metal strip 30 to be wrapped around a substantial portion of anode roll 22, and this closes the sites 39, 39 on that portion of roll 22 around which the continuous metal strip is wrapped. That portion of anode roll 22 around which metal strip 30 is wrapped is smaller than the peripheral portion of anode roll 22 around which mesh loop 38 extends, and mesh loop 38 is coextensive with metal strip 30 for the totality of the portion of the anode roll around which strip 30 is wrapped.

As shown in FIG. 4, wrapping metal strip 30 around anode roll 22 in the manner described above also provides a pair of spaced-apart nips between strip 30 and roll 22, namely an upstream nip 44, at the location of initial upstream contact between strip 30 and roll 22, and a downstream nip 45 at the location of final downstream contact between strip 30 and roll 22. Strip 30 and roll 22 are not, of course, in direct contact because of the mesh interposed therebetween.

Strip 30 is advanced in a downstream direction, as indicated by arrows 49, 50 in FIG. 1, by conventional driving structure (not shown) which may be located downstream (to the right) of the structure illustrated in FIG. 1 Simultaneous with the advancement of metal strip 30 in a downstream direction, anode roll 22 is rotated at the same speed as strip 30 so as to avoid slippage between the roll and the strip while maintaining the wrapped-around relationship between strip 30 and roll 22. In this connection, roll 22 may be an idler roll driven by the movement of strip 30 or it may itself be driven by driving structure of a conventional nature (not shown). The same driving arrangement may be utilized for rolls 24, 24 as for roll 22. That is, they may be idler rolls or they may have their own drivng structure. The important consideration is that the rolls be driven at the same speed as metal strip 30 so as to avoid slippage between the strip and the rolls.

Roll 35 should have a driving arrangement similar to that utilized fof roll 22. That is, roll 35 may be an idler roll or it may have its own driving structure. The important consideration is that roll 35 be driven at the same speed as metal strip 30 so as to avoid slippage between mesh loop 38 and metal strip 30.

As anode roll 22 and other roll 35 rotate, mesh loop 38 moves, and each point on mesh loop 38 moves through a series of circuits along a predetermined path defined by the closed loop.

As strip 30 advances in a downstream direction and roll 42 rotates, the sites 39, 39 which were previously covered by strip 30 become uncovered, and sites 39, 39 on a portion of roll 22 previously not wrapped by the strip become covered.

Electrolytic liquid is introduced onto roll 22, to flood the sites 39, 39 between strip inner surface 33 and roll peripheral surface 29, employing structure shown in FIG. 4. More particularly, located adjacent upstream nip 44 is the outlet end 52 of a conduit 53 for delivering electrolytic liquid to nip 44. Conduit 53 has an inlet end (not shown) communicating with bath 21 in tank 20.

Roll 22 rotates in a direction indicated by the arrow 46 in FIG. 4. Electrolytic liquid flows from conduit outlet end 52 at upstream nip 44 where the liquid floods the sites 39 closed by strip 30 as the strip advances and roll 22 rotates. Excess liquid is squeezed out of sites 39 at upstream nip 44 and accumulates at the nip, eventually spilling around strip side edges 31, 32 into tank 20 where the liquid forms part of bath 21 at the bottom of the tank from where the liquid may be recirculated through conduit 53 back to nip 44.

Electrolytic liquid is held within a given site closed by strip 30 for as long as strip 30 is in contact with that site, i.e., for the length of time it takes for the site to travel from upstream nip 44 to downstream nip 45. As strip 30 breaks contact with mesh loop 38 at downstream nip 45, electrolytic liquid within a site 39 at the downstream nip is no longer trapped or prevented from escaping from the site. This liquid then drains out of the site as the site is rotated beyond downstream nip 45, away from strip 30, and the liquid drops into bath 21 in tank 20.

The peripheral surface 29 of anode roll 22 is positively charged and strip 30 is negatively charged by virtue of the strip's contact with the peripheral surface of roll 24 which is negatively charged. The respective electrical charge is applied to the peripheral surfaces of rolls 22 and 24 employing conventional structure. As an alternative to employing roll 24 as an electrical contact roll for strip 30, a separate electrical contact roll for strip 30 may be provided as shown in dash-dot lines at 124 in FIG. 1.

Because strip 30 and peripheral surface 29 have opposite charges, an electric current may flow between the two through the electrolytic liquid in a flooded site 39. In other words, referring to FIG. 5, at each closed site there is an electrolytic cell wherein that portion of roll peripheral surface 29 defining site inner base 40 is the anode, that portion of strip inner surface 33 closing site 39 is the cathode and the electrolytic liquid within the closed site 39 is the electrolytic bath.

The electrolytic liquid contains cation of the metal to be plated, e.g., zinc cation. The flow of current between the anode roll's peripheral surface 29 and metal strip 30 causes cation to be deposited upon inner surface 33 of metal strip 30. Zinc is applied to inner strip surface 33 as the strip moves from upstream nip 44 to downstream nip 45.

Zinc is applied substantially only to that part of strip inner surface 33 which is in contact with the electrolytic liquid. More particularly, referring to FIG. 5, there are portions 49, 49 of strip inner surface 33 which are in contact with the site's side walls 41, 41 defined by the strands of mesh loop 38. Because these side walls are non-conductive, no zinc will be plated on those portions 49, 49 of strip inner surface 33 which are in contact with side walls 41, 41.

Metal strip 30 typically contacts twenty to forty different anode rolls 22 in a plating line (only one roll 22 being shown in FIG. 1). The mesh strands defining side walls 41, 41 on any one such anode roll are randomly oriented with respect to the side walls on the other anode rolls, so that side walls 41, 41 for a site 39 on any given roll 22 are not aligned with the side walls for a site 39 on most, if not all, of the other rolls 22. In other words, the sites 39 on one roll 22 overlap with the sites 39 on another roll 22. Accordingly, those portions 49, 49 on strip inner surface 33 which are unplated at one given anode roll 22 would not coincide with the portions 49, 49 which would be unplated at another given roll 22. Therefore, at the end of a sequence of twenty to forty anode rolls 22, 22, all of the area on inner surface 33 of strip 30 will be plated and to essentially the same thickness.

The walls 41, 41 defined by the mesh strands are very narrow, e.g., 0.03 to 0.09 inches (0.76 to 2.29 millimeters), and each cross-sectional dimension (i.e., width or length), of a site 39 may be about 0.06 to 0.91 inches (1.52 to 23.1 millimeters), for example.

Cation are depleted from the electrolytic liquid during the plating operation, and these cation are replenished from the peripheral surface 29 of depletable anode roll 22.

As previously indicated, side walls 41, 41 defined by the strands of mesh loop 38 are non-conductive. Because of this, those areas on peripheral surface 29 contacted by side walls 41, 41 will not be depleted during an electroplating operation. If the same areas on peripheral surface 29 were continuously contacted by side walls 41, 41 during succesive circuits of mesh loop 38, there would be a non-uniform erosion of peripheral surface 29. More particularly, those areas of peripheral surface 29 which were not contacted by side walls 41, 41 would be eroded away while those areas of peripheral surface 29 which were contacted by side walls 41, 41 would not be eroded away, resulting in the formation of craters indicated in dash-dot lines at 50 in FIG. 5.

Cratering is undesirable for a number of reasons. For one thing, it does not utilize to the maximum extent possible the plating metal in outer layer 28 of the depletable anode roll. Moreover, after the craters have formed, there may be a slight shifting movement on the part of the mesh loop from side to side, i.e., parallel to the axis of anode roll 22 (from left to right or vice versa as viewed in FIG. 5). When this occurs, part of the mesh which was previously supported atop an uneroded ridge, becomes unsupported; and the remainder of the supported mesh is subjected to increased pressure by the metal strip bearing against it. This crushes the mesh and requires more frequent replacement than would be the case if the mesh weren't crushed in that manner.

To avoid the drawbacks of cratering described in the preceding paragraph, and to provide for relatively uniform erosion of outer layer 28 of depletable anode roll 22 during an electrolytic plating process, structure is provided for assuring that different areas on peripheral surface 29 of anode roll 22 are left uncovered by the mesh strands on different circuits of the loop. The structure described in the last sentence is manifest by a path length for closed mesh loop 38 which is larger than the outside circumference of outer layer 28 on anode roll 22 and which is other than a whole number multiple of the outside circumference of outer layer 28, (e.g., 1.9 times the outside circumference of outer layer 28 rather than two times the outside circumference of outer layer 28). An arrangement of the type described in the preceding sentence provides for uniform erosion of outer layer 28 in a direction along the length of closed loop 38 (i.e., in a circumferential direction on outer layer 28).

As shown in FIG. 6, the porous mesh of which loop 38 is composed has openings (at 39) extending through the mesh, and these openings are uniformly sized and uniformly spaced apart from opening center to opening center, along both the length and the width of loop 38. Each such opening exposes an area on peripheral surface 29 of depletable anode roll 22 during part of a given circuit of the opening around the closed loop. As a further provision for assuring uniform erosion of outer layer 28 in a circumferential direction (i.e., along the length of loop 38), the path defined by the loop is provided with a length other than a whole number multiple of the dimension of an individual mesh opening, or the spacing between the openings, in a direction along the length of the path. (For example, if the distance from opening center to opening center is 0.5 in. (1.27 cm.), then the length of the path should be $100.25\times\frac{1}{2}$ in., rather than $100\times\frac{1}{2}$ in.) As a result, different respective areas on peripheral surface 29 are exposed by the openings in the porous mesh on consecutive circuits.

As previously indicated, there may be a tendency for mesh loop 38 to move slightly from side to side, parallel to the axis of anode roll 22, during operation. To the extent that this occurs, it can partially offset nonuniform erosion in a side-to-side or axially parallel direction on outer layer 28 of the anode roll. However, to assure uniform erosion, in a side-to-side direction on the outer layer of the anode roll, structure may be provided to train mesh loop 38 back and forth, in a side-to-side direction parallel to the axis of roll 22. Structure of this nature is illustrated in FIGS. 3 and 3A.

More particularly, each end of shaft 36 on roll 35 terminates at a bearing housing 55 having a lower depending key 56 slidably received within an upper keyway 57 in a slide block 58. Structure of the type described in the preceding sentence is shown for only one end of shaft 36 in FIGS. 3 and 3A, but the same structure would be associated with both ends of shaft 36. Associated with only one end of shaft 36, and located along one side of bearing housing 55 is a gear rack 59 engaged by a gear 60 driven by a motor 61.

The mechanism described in the preceding paragraph moves roll 37 in an axial direction when motor 61 is operated. This causes mesh loop 38 to move in an axially parallel direction, relative to anode roll 22, in turn causing that portion of mesh loop 38 which engages the anode roll's peripheral surface 29 to move in a sidewise direction along peripheral surface 29. This assures a uniform depletion of anode roll outer layer 28 in a side-to-side or axially parallel direction.

Because metal strip 30 is in tight, frictional engagement with mesh loop 38, around a substantial portion of anode roll 22, sidewise movement of mesh loop 38, relative to peripheral surface 29 on anode roll 22, will cause a similar movement on the part of the metal strip.

The structure for training mesh loop 38 from side to side prevents anode roll 22 from assuming a "dog bone" cross-sectional configuration along its axis as the anode roll undergoes depletion. A "dog bone" configuration is one in which a pair of undepleted end portions of relatively large diameter are connected by a depleted middle portion of relatively small diameter.

To allow for sidewise movement on the part of mesh loop 38 relative to anode roll 22, the mesh loop should have a width, between its opposed edge portions 47, 48, slightly less than the length, in an axial direction, of anode roll 22. The width of mesh loop 38 also should be at least as wide as metal strip 30 and preferably wider.

In those arrangements where dog-boning is not a problem or where the axial dimension of the depleted intermediate portion of the dog bone is greater than the width of mesh loop 38, there would be no problem if the width of metal strip 30 were less than the width of mesh loop 38. However, in those instances where the axial dimension of the dog bone's intermediate portion is less than the width of mesh loop 38 but no greater than the width of metal strip 30, means must be provided to trim at least one edge portion of mesh loop 38 to conform the width thereof to the width of the metal strip. Absent the provision of such trimming means, the outer edge portions of the wider mesh loop 38 would ride up along the side walls of the depleted intermediate portion of the dog bone and otherwise cause problems. An edge portion of the porous loop may be trimmed with a conventional rotary knife indicated diagrammatically at 51 in FIG. 3. Rotary knife 54 is mounted for reciprocal movement towards and away from mesh loop 38, as indicated by arrow 54 in FIG. 3, and this would be done employing conventional structure.

FIG. 7 illustrates an embodiment of porous mesh which provides uniform erosion, in a side-to-side or axially parallel direction, on outer layer 28 of the anode roll without moving mesh loop 38 back and forth in the side-to-side direction. As shown in FIG. 7, none of the strands 141, 141 are parallel to the axis of roll 22 or perpendicular to strands which are parallel to that axis. In the particular embodiment of FIG. 7, strands 141, 141 define a diamond-shaped pattern, but other patterns will produce a similar effect.

The arrangement of the strands 141, 141 in FIG. 7 is in contrast to the arrangement in FIG. 6 wherein a first group of mesh strands 41 (extending from left to right in FIG. 6) are parallel to the axis of roll 22 and a second group of strands 41 (extending from top to bottom in FIG. 6) are perpendicular to the first group of strands. As a result, in the absence of side-to-side movement of the mesh loop, the second group of strands 41 will normally cover the same areas on the anode roll's peripheral surface 29 on successive circuits of the mesh loop; and this will occur even if, on successive circuits, there is a shift, in a circumferential direction, of the area on peripheral surface 29 defined by the walls 41, 41 of a given cell. Such a circumferential shift will occur when the mesh loop's path length has a predetermined relationship to the circumference of the anode roll and to the dimension or spacing of the mesh openings, in a direction along the length of the mesh loop, as described above.

In contrast, in the embodiment of FIG. 7, whenever there is a shift in a circumferential direction on successive circuits, there will also be a shift in an axial direction because none of the strands 141, 141 is perpendicular to a line parallel to the axis of the anode roll.

As outer layer 28 on anode roll 22 is depleted, the diameter of anode roll 22 decreases. This, in turn, may cause slack in, and loosening of, mesh loop 38. Therefore, provision must be made for tightening mesh loop 38 to accommodate a reduction in the outer diameter of anode roll 22 as the latter undergoes depletion. This can be accomplished by mounting roll 35 for movement in a direction transverse to its axis, to permit loosening or tightening of mesh loop 38. More particularly, illustrated at 62 in FIGS. 3 and 3A, is a shaft 62 mounted for reciprocal movement in directions indicated by arrow 63 in FIG. 3. There is a shaft 62 for each slide block 58 on shaft 36 of roll 35. Movement of shaft 62 in the direction of arrow 63 is effected by conventional structure, e.g., by connecting shaft 62 to a hydraulic or pneumatic piston.

Shaft 62 is raised to tighten mesh loop 38 and take up the slack resulting from a depletion of anode roll 22 and a reduction in the latter's diameter. Shaft 62 is dropped to loosen mesh loop 38 to facilitate changing the mesh loop when it wears out.

The foregoing detailed description has been given for clearness of understanding only, and no unnecessary limitations should be understood therefrom, as modifications will be obvious to those skilled in the art.

I claim:

1. An apparatus for electrotreating a continuous metal strip, said apparatus comprising:

a depletable anode roll having an outer layer composed of plating metal, said outer layer having a peripheral surface;

another roll axially parallel to and spaced from said anode roll, said other roll having a peripheral surface;

a closed loop composed of electrically insulative, porous mesh having a plurality of mesh strands;

said porous mesh extending around a portion of the peripheral surface of each roll to form said closed loop;

some areas on said portion of the anode roll's peripheral surface being covered by said mesh strands and some areas being uncovered;

means mounting each of said rolls for rotation;

means, including each of said rolls, for moving each point on said porous mesh through a series of circuits along a predetermined path defined by said closed loop, in response to rotation of said depletable anode roll;

and means for assuring that different areas on the peripheral surface of said anode roll are left uncovered by said mesh strands on different circuits of said loop, to provide for relatively uniform erosion of said outer layer of the depletable anode roll during an electrolytic plating process.

2. An electrotreating apparatus as recited in claim 1 wherein said last recited means comprises:

a path length for said closed loop which is larger than the outside circumference of said outer layer on the anode roll and which is other than a whole number multiple of said outside circumference of said outer layer.

3. An electrotreating apparatus as recited in claim 2 wherein:

said porous mesh has openings extending therethrough which are uniformly sized and uniformly spaced apart from opening center to opening center along the length of said loop;

each opening exposing a portion on the peripheral surface of said depletable anode roll during a given circuit of said opening around said closed loop;

said path length being other than a whole number multiple of said spacing between said openings, so that different respective areas of said peripheral surface are exposed by said openings on consecutive circuits.

4. An electrotreating apparatus as recited in claim 2 wherein:

said porous mesh has a multiplicity of openings extending therethrough, each opening being defined by a plurality of mesh strands;

substantially none of said mesh strands being perpendicular to a line parallel to the axis of said anode roll.

5. An electrotreating apparatus as recited in claim 4 wherein:

substantially none of said mesh strands are parallel to the axis of said anode roll.

6. An electrotreating apparatus as recited in claim 1 and comprising:

means for introducing electrolytic liquid onto that part of said porous mesh which extends around said anode roll.

7. An electrotreating apparatus as recited in claim 1 and comprising:

means for wrapping a portion of a continuous metal strip of predetermined width around a substantial portion of said anode roll and that part of the porous mesh extending around said substantial portion of the anode roll, with said porous mesh being located between said metal strip and the peripheral surface of said anode roll to prevent direct electrical contact between the metal strip and the peripheral surface of the anode roll.

8. An electrotreating apparatus as recited in claim 7 wherein:

said porous mesh is at least as wide as said metal strip.

9. An electrotreating apparatus as recited in claim 8 wherein:

said porous mesh has a predetermined width corresponding to said predetermined width of said metal strip.

10. An electrotreating apparatus as recited in claim 8 wherein:

said porous mesh has a pair of opposed edge portions and an initial width greater than said predetermined width of said metal strip.

11. In combination with the electrotreating apparatus of claim 10:

means for trimming at least one edge portion of said porous mesh to conform the width thereof to said predetermined width of said metal strip.

12. An electrotreating apparatus as recited in claim 7 and comprising:

means mounting said other roll for movement along its axis.

13. An electrotreating apparatus as recited in claim 12 and comprising:

means mounting at least one of said rolls for movement in a direction transverse to its axis to permit loosening and tightening of said loop.

14. An electrotreating apparatus as recited in claim 7 and comprising:

means mounting at least one of said rolls for movement in a direction transverse to its axis to permit loosening and tightening of said loop.

* * * * *

UNITED STATES PATENT AND TRADEMARK OFFICE

CERTIFICATE OF CORRECTION

PATENT NO. : 4,416,756

DATED : November 22, 1983

INVENTOR(S) : Frank A. Martin

It is certified that error appears in the above-identified patent and that said Letters Patent are hereby corrected as shown below:

Col. 5, line 18, after "Fig. 1" insert a period;

Col. 5, line 28, "drivng" should be --driving--;

Col. 5, line 33, "fof" should be --for--;

Col. 5, line 43, "roll 42" should be --roll 22--;

Col. 7, line 7, "succesive" should be --successive--.

Signed and Sealed this

*Fourteenth* Day of *February 1984*

[SEAL]

*Attest:*

GERALD J. MOSSINGHOFF

*Attesting Officer*

*Commissioner of Patents and Trademarks*